US005817378A

United States Patent [19]

Otani

[11] Patent Number: 5,817,378

[45] Date of Patent: Oct. 6, 1998

[54] THREE-DIMENSIONAL, CUT-AND-FOLDED PAPER OR PAPERLIKE SHEET ARTICLE AND A HOLDER FOR THE SAME

[75] Inventor: Yoshiteru Otani, Tokyo, Japan

[73] Assignee: Sho-Ei Pack Co., Ltd., Tokyo, Japan

[21] Appl. No.: 503,858

[22] Filed: Jul. 18, 1995

[30] Foreign Application Priority Data

Sep. 13, 1994 [JP] Japan ..... 6-012478 U

[51] Int. Cl.[6] ..... G09F 1/08

[52] U.S. Cl. ..... 428/12; 40/124.08; 40/539; 446/148

[58] Field of Search ..... 428/12, 7; 40/124.08, 40/539; 446/148

[56] References Cited

U.S. PATENT DOCUMENTS 2,395,578 2/1946 Pergande ..... 428/12 X 3,191,328 6/1965 Lohnes ..... 428/12 X 4,103,444 8/1978 Jones et al. ..... 428/12 X

*Primary Examiner*—Henry F. Epstein

*Attorney, Agent, or Firm*—Jones, Tullar & Cooper, P.C.

[57] ABSTRACT

A three-dimensional, cut-and-folded paper or paper sheet article is described. The article comprises a sheet of paper or paperlike sheet folded along a transverse line in two halves which are perpendicular to each other, and a series of cutout parts projecting one from another and erected on one half at intervals, with the cutout parts being parallel to each other and to the other half. The series of projected parts have shapes varying continuously, and such developing shapes can be of any desired form, such as human or animal shapes. Three-dimensional, cut-and-folded paper articles each having a series of shapes varying but continuing in context can be applied to picture books, greeting cards and the like, providing attractive goods in the market.

4 Claims, 7 Drawing Sheets

THREE-DIMENSIONAL, CUT-AND-FOLDED PAPER OR PAPERLIKE SHEET ARTICLE AND A HOLDER FOR THE SAME

BACKGROUND OF THE INVENTION

1. Field of the Invention

The present invention relates to a three-dimensional, cut-and-folded paper or paper sheet article and a holder for the same. Such three-dimensional, cut-and-folded paper or paperlike sheet articles may be applied to picture books which have three-dimensional shapes appearing when opening selected pages.

2. Description of the Prior Art

FIG. 8 shows a sheet of paper 13 having patterns 14 and 15 cut out partly along their contours. When the sheet of paper 13 is forded along its traverse line 16, and when the patterns 14 and 15 are pushed forward and folded along their broken lines, a square projection 17 and a bulge column 18 appear on the folded sheet, as shown in FIG. 7.

These shapes are separate and independent from each other, and are simple and less attractive.

SUMMARY OF THE INVENTION

One object of the present invention is to provide a three-dimensional, cut-and-folded paper or paper sheet article having different shapes connected together to provide a three-dimensional attractive composite shape.

Another object of the present invention is to provide such a three-dimensional, cut-and-folded paper or paperlike sheet article having means to stably support the whole shape.

To attain these objects a three-dimensional, cut-and-folded paper or paperlike sheet article according to the present invention comprises a sheet of paper or paperlike sheet folded along a transverse line in two halves which are perpendicular to each other, and a series of cutout parts projecting one from another and erected on one half at intervals, which cutout parts are parallel to each other and to the other half, and are connected at their ends by a ceiling plane extending from the other half, the shapes of the cutout parts varying continuously as viewed forward from the other half so that the shape of the most forward part is totally different from the most backward part.

Also, a three-dimensional, cut-and-folded paper or paperlike sheet article according to the present invention comprises a sheet of paper or paperlike sheet folded along a transverse line in two halves which are perpendicular to each other, and a series of cutout parts projecting one from another and erected on one half at intervals, which cutout parts are parallel to each other and to the other half, and are connected at their opposite sides by step-like flat connections, the shapes of the cutout parts varying continuously as viewed forward from the other half so that the shape of the most forward part is totally different from the most backward part.

A three-dimensional, cut-and-folded paper or paperlike sheet article according to the present invention further comprises a holder, which is composed of another sheet of paper or paperlike sheet folded along a transverse line in two halves which are perpendicular to each other, each half having a retainer section at each corner to hold the corresponding corner of the cut-and-folded paper or paperlike sheet article, the other sheet of paper or paperlike sheet having a rectangular-folded projection integrally connected to each half to support the cut-and-folded paper or paperlike sheet article behind, the rectangular-folded projection comprising two perpendicular planes each erected on each half with their joint ridge running parallel to the transverse line of the other sheet of paper or paperlike sheet.

BRIEF DESCRIPTION OF THE DRAWINGS

Other objects and advantages of the present invention will be understood from the following description of three-dimensional, cut-and-folded paper or paper sheet articles according to preferred embodiments of the present invention, which are shown in the accompanying drawings.

DETAILED DESCRIPTION OF PREFERRED EMBODIMENTS

Figure 1:
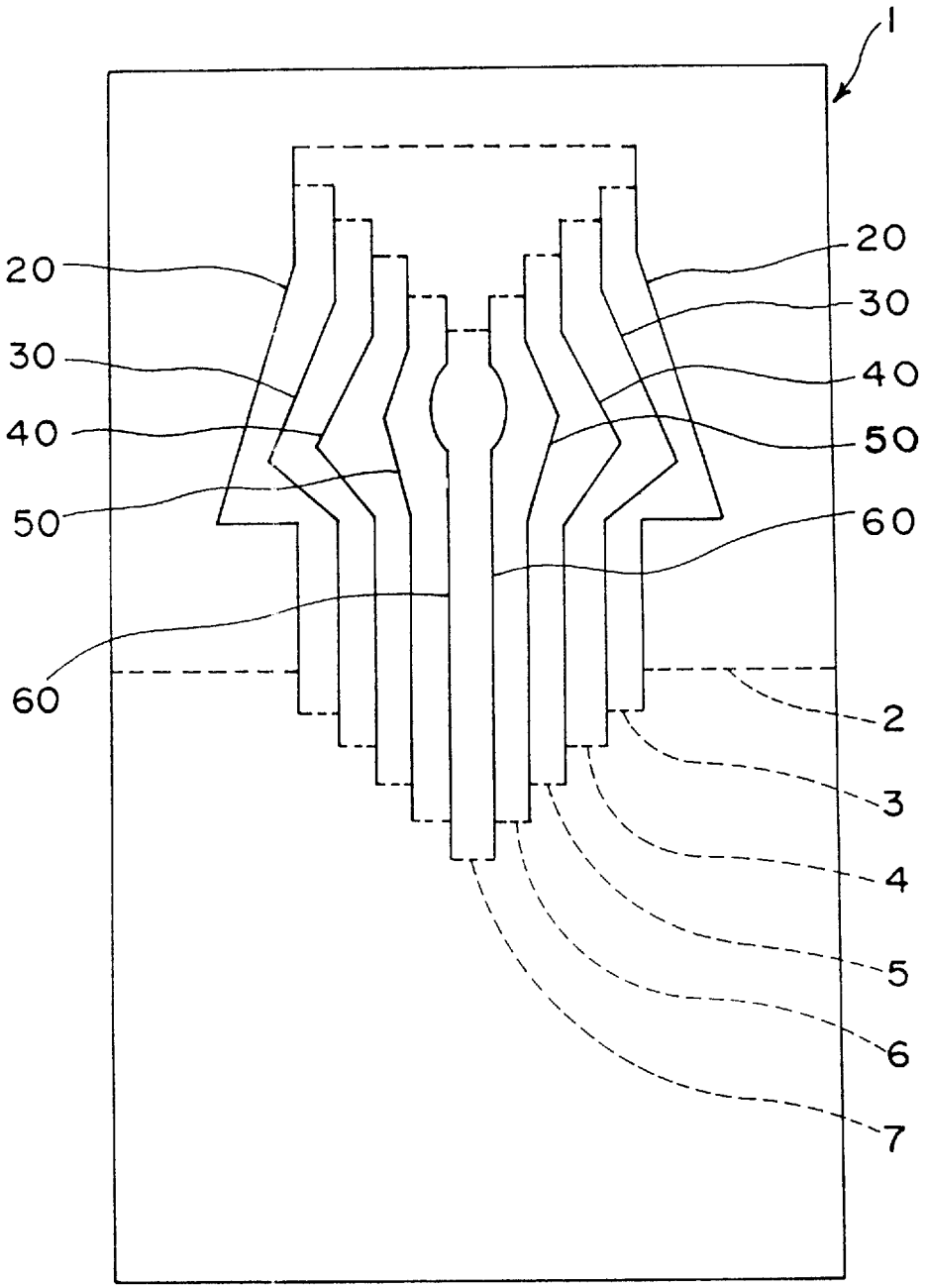
FIG. 1 is a plane view of a sheet of paper having patterns cut out along their contours according to a first embodiment of the present invention.
Figure 2:
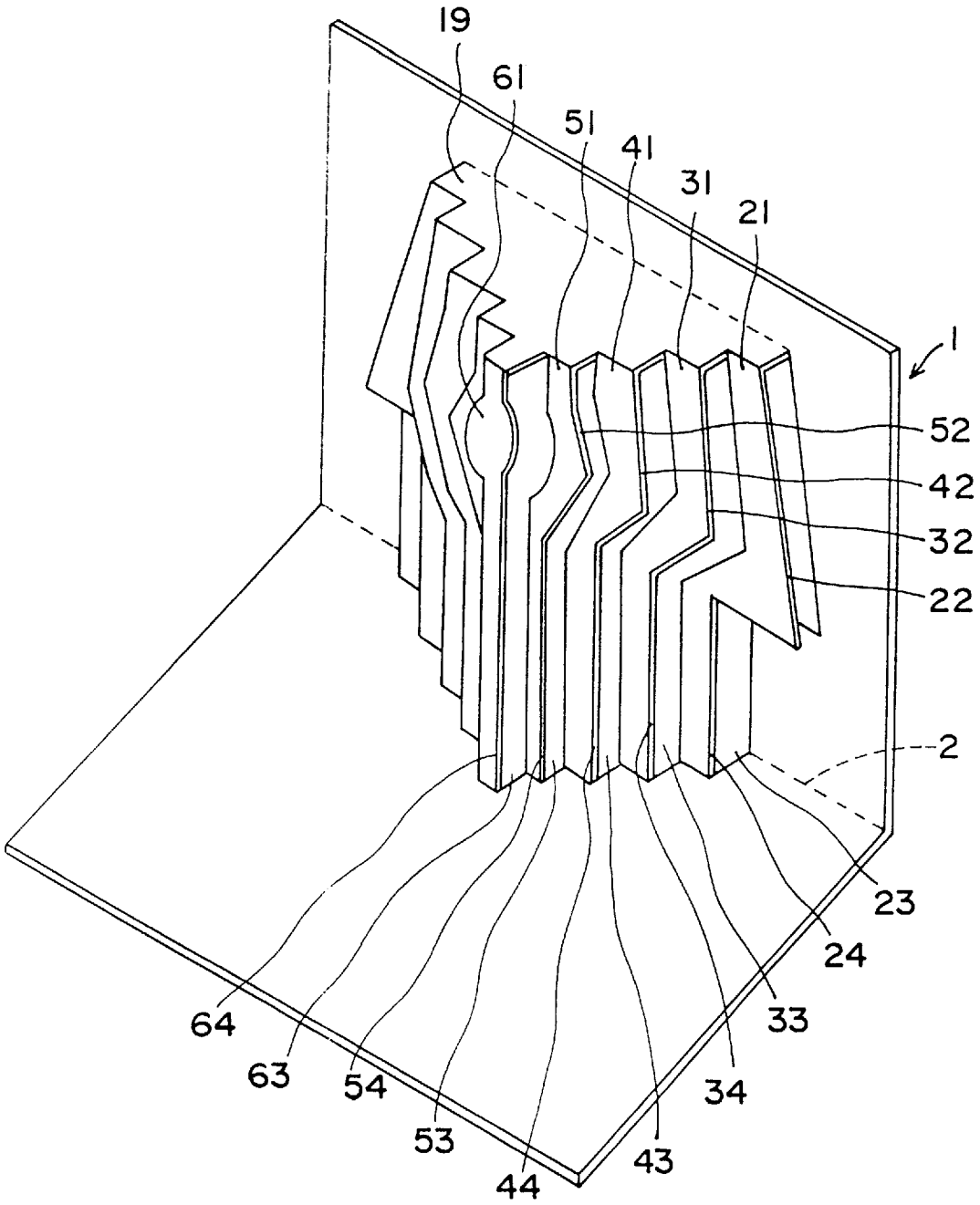
FIG. 2 is a perspective view of a three-dimensional, cut-and-folded paper article made of the sheet of paper of FIG. 1.

Referring to FIGS. 1 and 2, a three-dimensional, cut-and-folded paper article according to a first embodiment of the present invention is made of a sheet of paper 1 having a plurality of patterns 20, 30, 40, 50 and 60 cut out along their contours. The sheet of paper 1 and the cut-out patterns 20, 30, 40, 50 and 60 are folded along their folding lines 2, 3, 4, 5, 6 and 7 (broken lines), and then the patterns 20, 30, 40, 50 and 60 are projected forward to form a three-dimensional structure.

When the sheet of paper 1 is folded along the transverse line 2 in two halves which are perpendicular to each other, the parts 21, 31, 41, 51 and 61 rise up with their top ends connected to the ceiling plane 19 extending from the vertical wall, as seen from FIG. 2.

The most rearward or tail part 21 has two angulated side-expansions 22. The contour line of the pattern 20 (FIG. 1) is raised one step higher than the major sheet surface by folding and erecting the ceiling plane 19 on the major sheet surface of the vertical wall, and by folding the part 21 along its opposite folding lines 3 (FIG. 1), thus forming an elongated space 23 on either side of the part 21 (FIG. 2). The part 21 stands on its legs 24.

Likewise, parts 31, 41, 51 and 61 have elongated spaces 33, 43, 53 and 63, standing on their legs 34, 44, 54 and 64 respectively. Thus, these parts 21, 31, 41, 51 and 61 stand parallel to each other at regular intervals.

The most forward or head part 61 has a bulged-strip shape, not leaving such an opening space as in the other parts because of no projected part therefrom. As seen from FIG. 2, the most forward part 61 is totally different from the most rearward or tail part 21 in shape.

It should be noted that the opposite angulated side-expansions 22, 32, 42 and 52 of the sequential parts 21, 31, 41, and 51 vary continuously in shape. Specifically, the angulated side-expansions 32 rise higher than the angulated side-expansions 22, and the angulated side-expansions 32 has an angle somewhat larger than the angle of the angulated side-expansions 22. The following angulated side-expansions have similar continuous variations, but finally the most forward part 61 has a bulged-strip shape rather than the angulated side-expansion.

Figure 3:
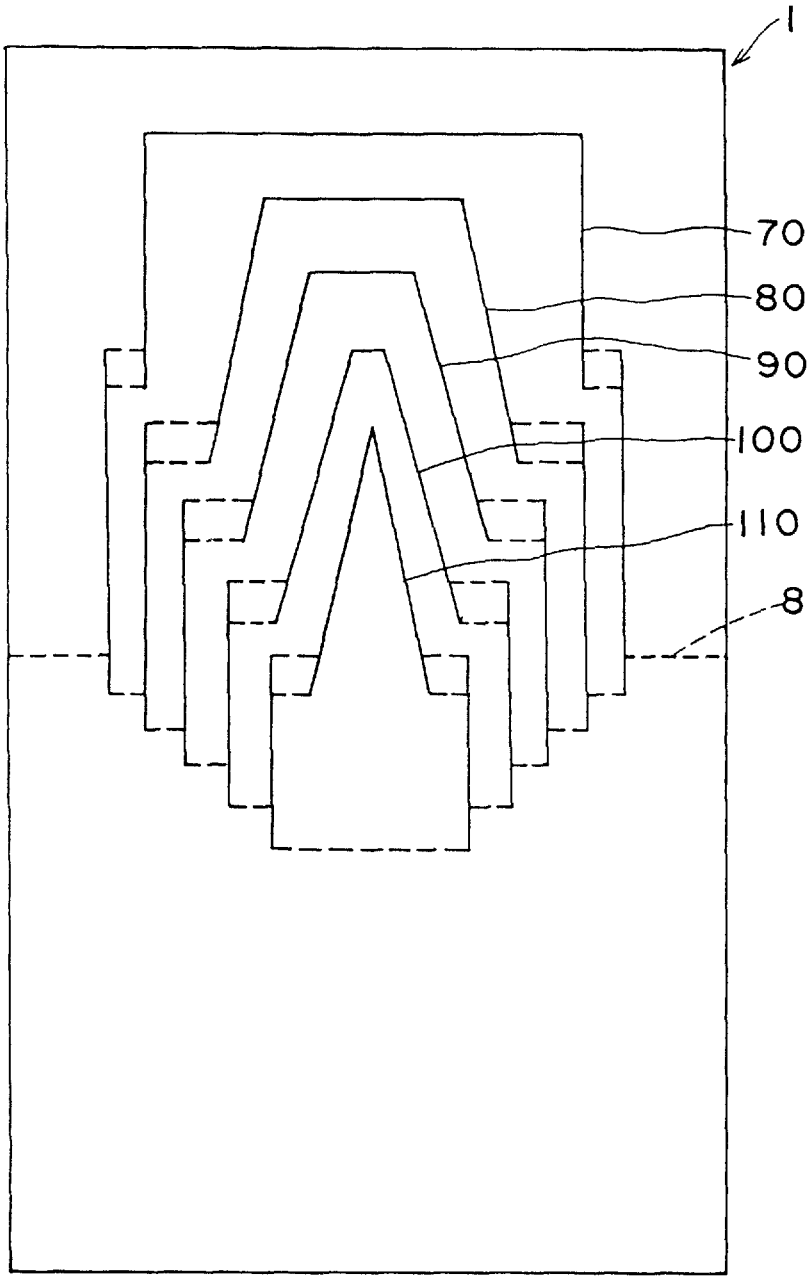
FIG. 3 is a plane view of a sheet of paper having patterns cut out along their contours according to a second embodiment of the present invention.
Figure 4:
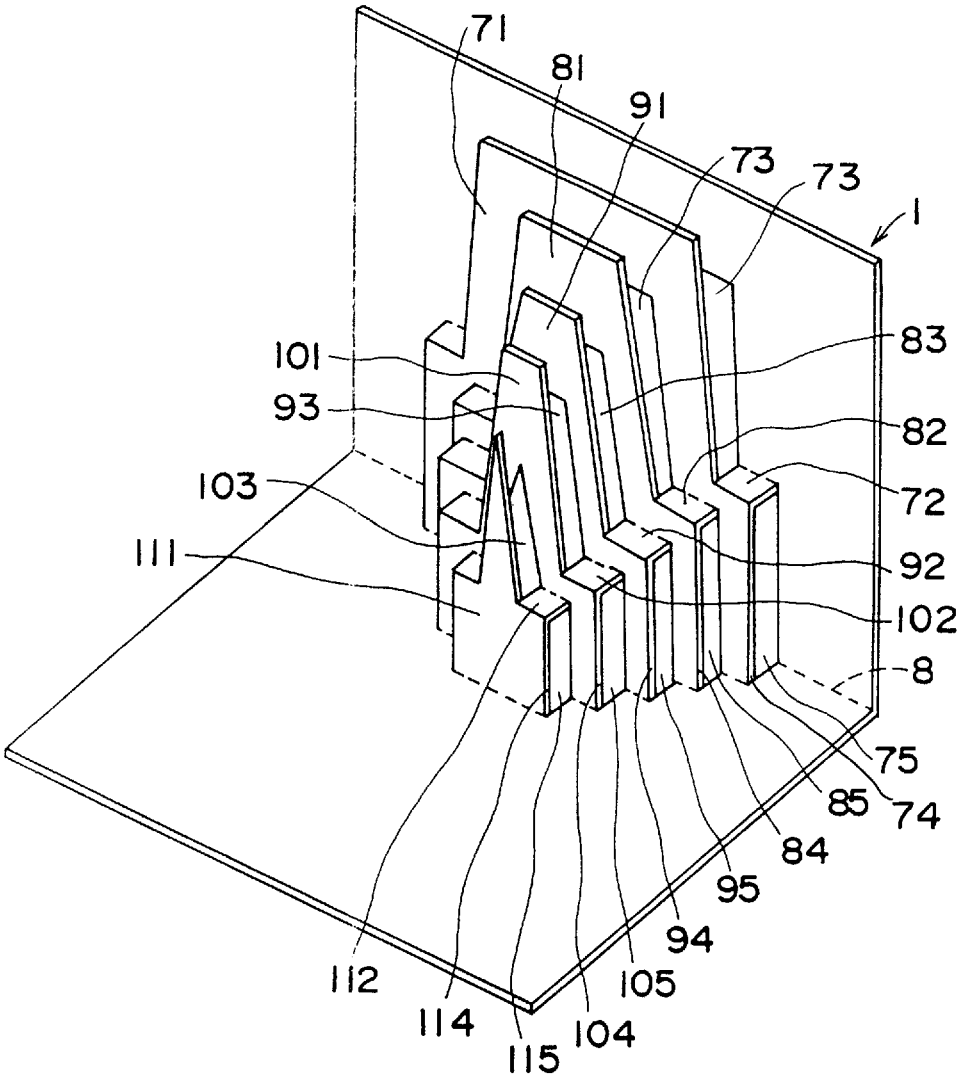
FIG. 4 is a perspective view of a three-dimensional, cut-and-folded paper article made of the sheet of paper of FIG. 3.

Referring to FIGS. 3 and 4, a three-dimensional, cut-and-folded paper article according to a second embodiment of the present invention is made of a sheet of paper 1 having a plurality of patterns 70, 80, 90, 100 and 110 cut out along their contours. These patterns 70, 80, 90, 100 and 110 are projected one from another to form a line-up of arch-like shapes ending with a triangular shape.

The most rearward projected part 71 is rectangular, and has an opening 73 to form the subsequent, projected part 81. The most rearward projected part 71 stands on its opposite legs 74, having opposite step-like flat connections 72. The pattern 70 is raised to leave another encircling space 73, this time between the projected part 71 and the vertical wall.

Likewise, the subsequent projected parts 81, 91, 101 and 111 stand on their opposite legs 84, 94, 104 and 114, having opposite step-like flat connections 82, 92, 102 and 112. The patterns 80, 90, 100 and 110 are raised to leave encircling spaces 83, 85; 93, 95; 103, 105 and 115.

These projected parts 71, 81, 91, 101 and 111 are erected on the horizontal floor at regular intervals. The most forward projected part 111 is triangular in shape, totally different from the most rearward part of the rectangular arch-like shape. The sequential projected parts vary in shape, starting from the rectangular arch-like shape 71, changing to trapezoids having gradually narrowing and lowering tops 91, 101 and ending with the triangular shape 111.

The series of projected parts have shapes varying continuously, and such developing shapes can be of any desired form, such as human animal shapes.

Figure 5:
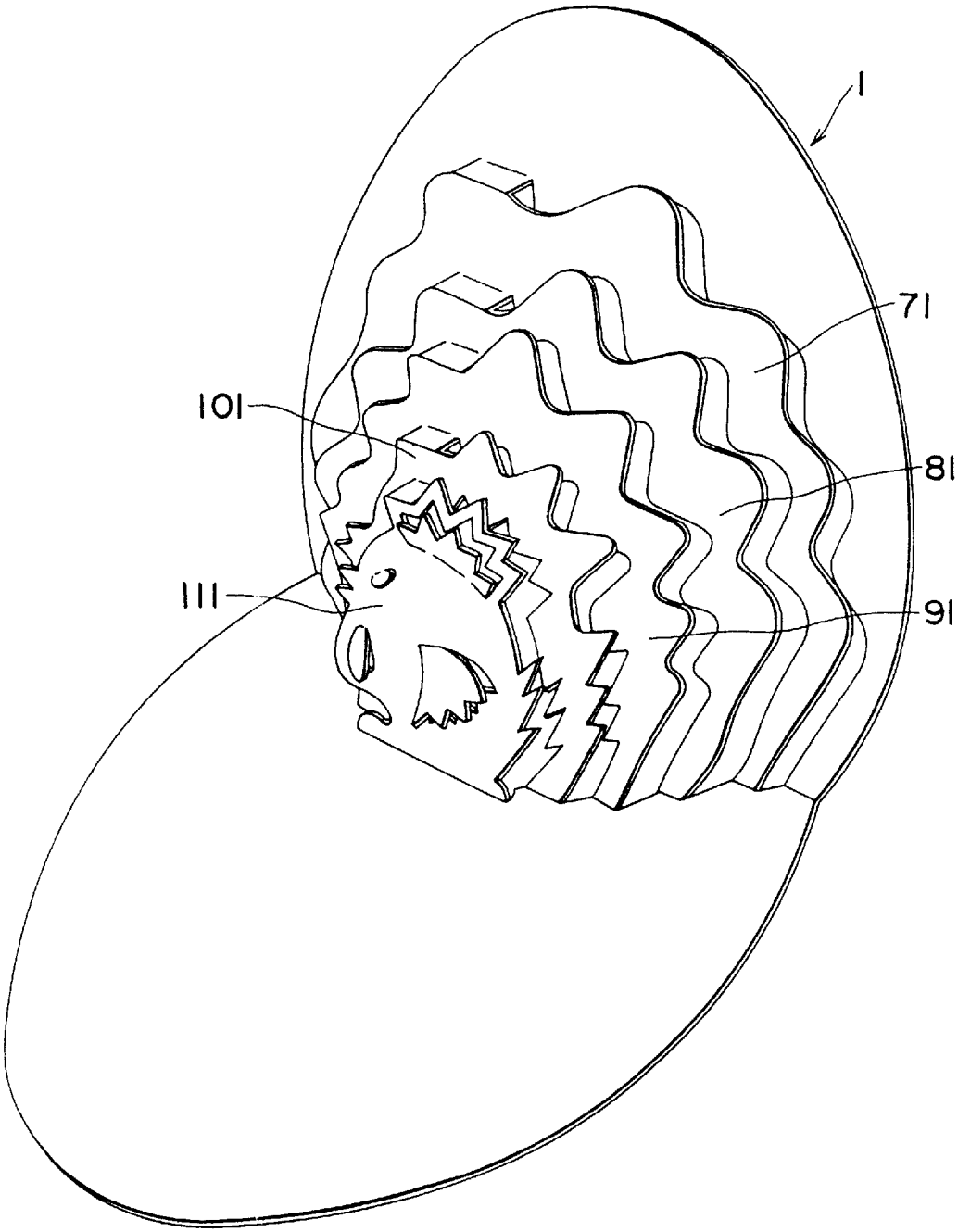
FIG. 5 is a perspective view of a three-dimensional, cut-and-folded paper article according to a third embodiment.

FIG. 5 shows one actual example of such a shape. The sheet of paper is like an egg shape, and the most forward projected part 111 is like a cock in shape. The intervenient projected parts 71, 81, 91 and 101 have shapes developing from the egg to the cock. As may be supposed, three-dimensional, cut-and-folded paper articles each having a series of shapes varying but continuing in context are attractive goods in the market.

Figure 6:
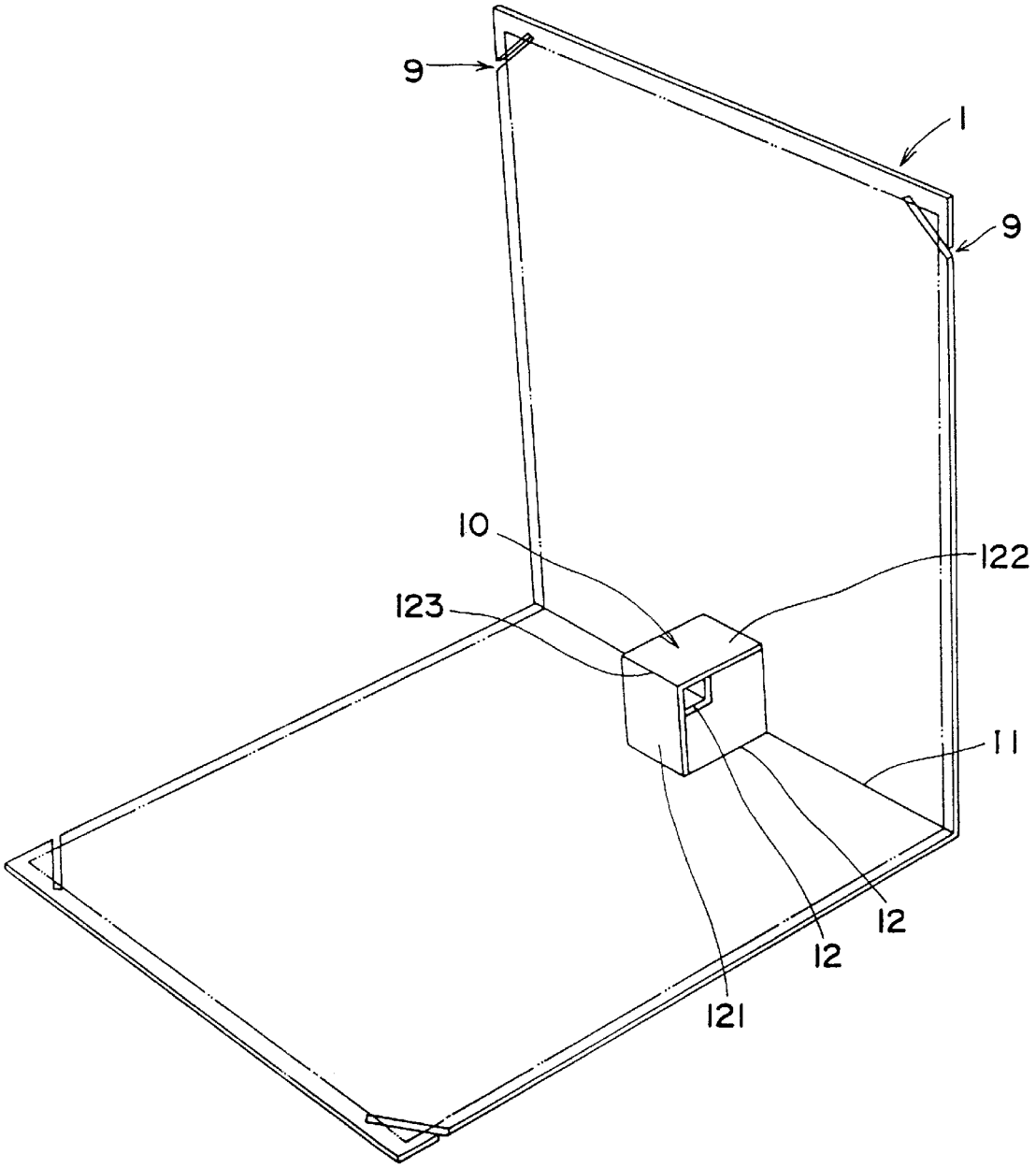
FIG. 6 is a perspective view of a paper holder to support a three-dimensional, cut-and-folded paper article.
Figure 7:
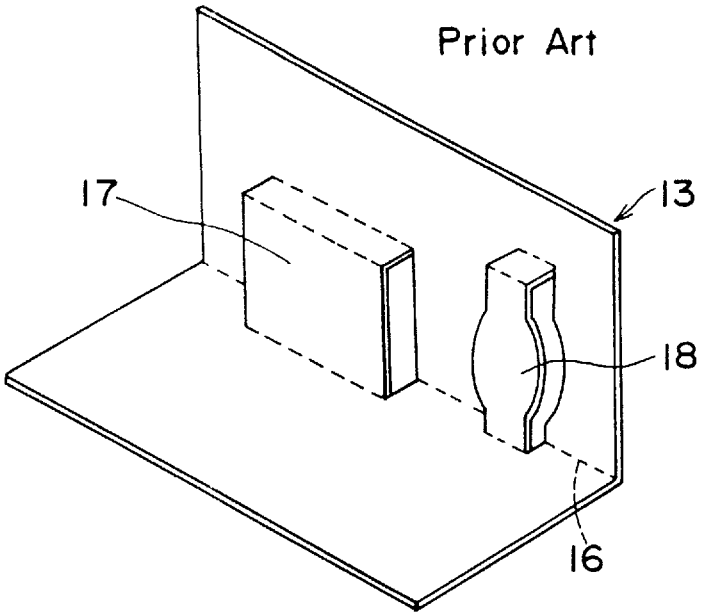
FIG. 7 is a perspective view of conventional three-dimensional, cut-and-folded paper article.
Figure 8:
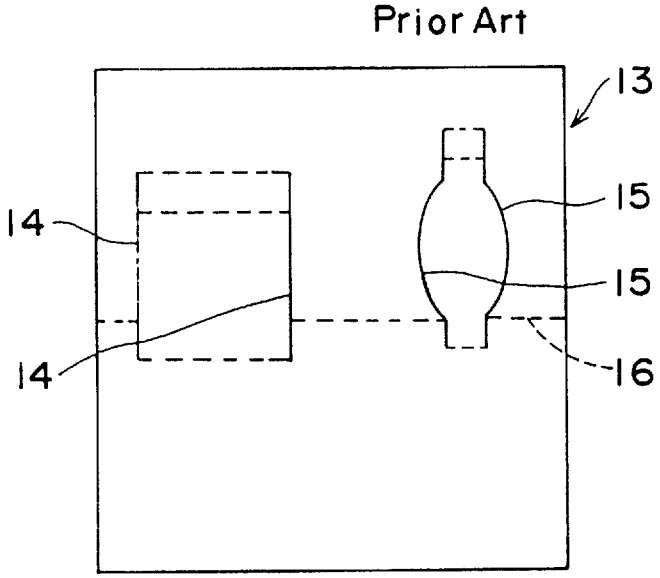
FIG. 8 is a plane view of a sheet of paper having patterns cut out along their contours, of which the sheet of paper the conventional three-dimensional, cut-and-folded paper article of FIG. 7 is made.

FIG. 6 shows a paper holder for holding such a three-dimensional, cut-and-folded paper article.

It is composed of a rectangular sheet of paper 1 folded along a transverse line 11 in two halves which are perpendicular to each other. Each half has a retainer section 9 at each corner to hold the corresponding corner of the three-dimensional, cut-and-folded paper article. The retainer section 9 can be formed by making an inclined slot at the corners or by fixing a small bag-like retainer. Each corner of the three-dimensional, cut-and-folded paper article is put in the oblique slot of the corresponding corner of the paper stand, or is inserted in the small bag-like retainer. Also, the paper stand has a rectangular-folded projection 10 integrally connected to each half to support the three-dimensional, cut-and-folded paper behind. The rectangular-folded projection 10 comprises two perpendicular planes 121 and 122, each erecting on each half with their joint ridge 123 running parallel to the transverse line 11 of the rectangular sheet of paper.

The rectangular-folded projection 10 can be formed by cutting two parallel lines perpendicular to the transverse line 11 of the rectangular sheet of paper, and by thrusting and folding the rectangular area defined by the opposite cut-out lines and the folding lines perpendicular thereto, thereby erecting the vertical part 121 on the horizontal floor and the horizontal part 122 on the vertical wall respectively.

A three-dimensional, cut-and-folded paper article can be held stably by the paper stand with its four corners caught by the corner retainers of the paper stand.

Also, advantageously, if a three-dimensional, cut-and-folded paper article is folded flat along with its paper stand, the composite article can be put in and taken out from a bag-like container without its projected parts being caught by the opening circumference of the bag-like container.

The paper stand may have a picture of the three-dimensional, cut-and-folded paper article printed on its front, and if it is put in a transparent bag-like container, the content can be noticeable from the outside when exhibited for sale.

The three-dimensional, cut-and-folded paper article can be applied to picture books, toys and greeting cards. The stand and the three-dimensional, cut-and-folded article may be made of materials other than paper, such as plastic sheet or leather.

What is claimed is:

1. A three-dimensional, cut-and-folded paper sheet article defining a transverse line, comprising: a paper sheet folded along said transverse line in two halves which can be moved to be perpendicular to each other; and a series of cutout parts projecting one from another and erected on one half of said paper sheet at intervals, which cutout parts are parallel to each other and to said other half of said paper sheet, and are connected at their ends by a ceiling plane extending from said other half of said paper sheet, the shapes of said cutout parts varying continuously as viewed forward from said other half of said paper sheet so that the shape of the most forward part is totally different from the most backward part.

2. A three-dimensional, cut-and-folded paper sheet article according to claim 1, further comprising: a holder, composed of another paper sheet defining a transverse line which is folded along said transverse line in two halves which can be moved to be perpendicular to each other, each half having a retainer section at each corner to hold the corresponding corner of the cut-and-folded paper sheet article, said another paper sheet having a rectangular-folded projection integrally connected to each half to support the cut-and-folded paper sheet article from behind, said rectangular-folded projection comprising two perpendicular planes each erected on each half with their joint ridge running parallel to the transverse line of said another paper sheet.

3. A three-dimensional, cut-and-folded paper sheet article defining a transverse line, comprising: a paper sheet folded along said transverse line in two halves which can be moved to be perpendicular to each other; and a series of cutout parts projecting one from another and erected on one half of said paper sheet at intervals, which cutout parts are parallel to each other and to said other half of said paper sheet, and are connected at their opposite sides by step-like flat connections, the shapes of said cutout parts varying continuously as viewed forward from said other half of said paper sheet so that the shape of the most forward part is totally different from the most backward part.

4. A three-dimensional, cut-and-folded paper sheet article according to claim 3, further comprising: a holder, composed of another paper sheet defining a transverse line which is folded along said transverse line in two halves which can be moved to be perpendicular to each other, each half having a retainer section at each corner to hold the corresponding corner of the cut-and-folded paper sheet article, said another paper sheet having a rectangular-folded projection integrally connected to each half to support the cut-and-folded paper sheet article from behind, said rectangular-folded projection comprising two perpendicular planes each erected on each half with their joint ridge running parallel to the transverse line of said another paper sheet.

* * * * *